US009425007B2

(12) United States Patent
Kim

(10) Patent No.: US 9,425,007 B2
(45) Date of Patent: Aug. 23, 2016

(54) PRESSURE-TYPE CONTACT SWITCH FOR USE IN OPERATION OF PRESSURE PUMP

(71) Applicant: Moo Sung Kim, Goyang (KR)

(72) Inventor: Moo Sung Kim, Goyang (KR)

( * ) Notice: Subject to any disclaimer, the term of this patent is extended or adjusted under 35 U.S.C. 154(b) by 0 days.

(21) Appl. No.: 14/492,779

(22) Filed: Sep. 22, 2014

(65) Prior Publication Data

US 2016/0086751 A1 Mar. 24, 2016

(51) Int. Cl.

| | |
|---|---|
| ***H01H 9/00*** | (2006.01) |
| ***H01H 35/36*** | (2006.01) |
| ***H01H 35/30*** | (2006.01) |

(52) U.S. Cl.

CPC ..... *H01H 35/36* (2013.01); *H01H 35/30* (2013.01); *H01H 2207/026* (2013.01); *H01H 2221/016* (2013.01); *H01H 2221/024* (2013.01); *H01H 2221/04* (2013.01)

(58) Field of Classification Search

CPC ..... H01H 36/00; H01H 37/42; H01H 35/36; H01H 35/30; H01H 2207/026; H01H 2221/016; H01H 2221/04; H01H 2221/024

USPC ..... 335/205; 200/81.8

See application file for complete search history.

(56) References Cited

U.S. PATENT DOCUMENTS

| | | | | |
|---|---|---|---|---|
| 4,374,475 | A * | 2/1983 | Hestich | 73/736 |
| 4,485,727 | A * | 12/1984 | Shollenbarger | H01H 35/2635 200/81.8 |
| 4,529,961 | A * | 7/1985 | Nishimura et al. | 340/447 |
| 4,850,228 | A * | 7/1989 | Iizumi | 73/727 |
| 5,286,931 | A * | 2/1994 | Murphy | G01L 7/043 200/56 R |
| 5,640,992 | A * | 6/1997 | Huang | G01L 7/043 137/487.5 |

FOREIGN PATENT DOCUMENTS

| | | |
|---|---|---|
| KR | 1981-0000744 | 6/1981 |
| KR | 1989-0000633 | 3/1989 |

* cited by examiner

*Primary Examiner* — Bernard Rojas

(74) *Attorney, Agent, or Firm* — Kile Park Reed & Houtteman PLLC

(57) ABSTRACT

A pressure-type contact switch includes a bourdon tube which expands and contracts depending on water pressure in a discharge conduit applied by a pressure pump; a link having an end connected to a free end of the bourdon tube; a first actuating lever having an end connected to the other end of the link and rotatably installed about a first rotation axis; a first semi-circle gear formed at the other end of the first actuating lever; a first link gear engaged with the first semi-circle gear and fitted to a central rotation axis to thereby cause the central rotation axis to rotate in normal and reverse directions; a rotation member fitted to the central rotation axis; a second actuating lever which is installed to the rotation member to be rotatable about a second rotation axis; and an extension lever fitted to an end of the second actuating lever.

2 Claims, 4 Drawing Sheets

PRESSURE-TYPE CONTACT SWITCH FOR USE IN OPERATION OF PRESSURE PUMP

FIELD OF THE INVENTION

The present invention relates to a pressure-type contact switch, which performs ON/OFF operation by way of expansion/contraction of a bourdon tube according to an operation/cessation of a pressure pump. More particularly, the present invention relates to a pressure-type contact switch which uniformly maintains ON/OFF state of the switch using a plurality of magnets, despite instantaneous change in pressure. Thus, the pressure-type contact switch of the present invention makes it possible to minimize the erroneous operations of the ON/OFF contacts and the pressure pump to thereby provide improved reliability in use.

BACKGROUND OF THE INVENTION

Generally, a pressure-type contact switch operates to turn on/off power supply applied to a pressure pump using expansion and contraction of a bourdon tube connected to a discharge conduit, according to change in water-pressure passing the discharge conduit by means of the pressure pump.

In the pressure-type contact switch described above, a movable support is installed between two contact points. The movable support rotates to move toward one contact point to thereby turn on the pressure pump when the pressure in the bourdon tube decreases, whereas the movable support rotates to move toward the other contact points to thereby turn off the pressure pump when the pressure in the bourdon tube increases.

The pressure-type contact switch for use in operation and cessation of the pressure pump begins or ceases the operation of the pressure pump according to on-state or off-state of the contact points. Here, the contact points might be damaged and the pressure pump could operate incorrectly, because the on/off-states of the contact points are continuously repeated due to instantaneous change in pressure according to the operation and the cessation of the pressure pump.

In order to avoid the above-described problem, it is possible to include a magnetic maintenance circuit within a start circuit of the pressure pump, which maintains on/off-state for a certain period of time. However, the magnetic maintenance circuit is a high-priced item, so that it increases the manufacturing cost of the contact switch.

PRIOR ART

Korean Utility Model Application No. 20-1986-1131
Korean Utility Model Application No. 20-1980-2335

SUMMARY OF THE INVENTION

An object of the present invention is to solve the above-described problems of the prior art by providing a pressure-type contact switch, which can perform its on/off operation by way of the expansion and the contraction of the bourdon tube according to the operation and the cessation of the pressure pump, wherein on/off state of the contact switch is uniformly maintained using a plurality of magnets despite instantaneous change in pressure, to thereby minimize the incorrect operations of the on/off contacts and the pressure pump and to increase the reliability in use.

According to the present invention, there is provided a pressure-type contact switch comprising: a bourdon tube which expands and contracts depending on water pressure in a discharge conduit applied by a pressure pump; a link having an end connected to a free end of said bourdon tube; a first actuating lever having an end connected to the other end of said link and rotatably installed about a first rotation axis; a first semi-circle gear formed at the other end of said first actuating lever; a first link gear engaged with said first semi-circle gear and fitted to a central rotation axis to thereby cause said central rotation axis to rotate in normal and reverse directions; a rotation member fitted to said central rotation axis; a second actuating lever which is installed to said rotation member to be rotatable about a second rotation axis; an extension lever fitted to an end of said second actuating lever, wherein a rotation of said extension lever in normal and reverse directions is limited by a movable support rod and a stationary support rod; a second semi-circle gear formed at the other end of said second actuating lever; a holder fitted to an upper end of a third rotation axis and having a rotation magnet inserted therein; a second link gear fitted to a lower end of said third rotation axis and engaged with said second semi-circle gear to thereby rotate said third rotation axis in normal and reversed directions depending on the rotation of said second semi-circle gear; a movable magnet arranged to be aligned with said rotation magnet in a straight line when said rotation magnet stops in its rotation by a first stopper, wherein the pressure pump turns off due to repulsive force between said rotation magnet and said movable magnet; and a stationary magnet arranged to be aligned with said rotation magnet in a straight line when said rotation magnet stops in its rotation by a second stopper, wherein the pressure pump turns on when the stationary magnet is aligned with the rotation magnet.

According to an aspect of the present invention, said movable magnet is fixed to a contact plate which is elastically bendable, and said contact plate is separated from a stationary contact to thereby turn off the pressure pump when said movable magnet is aligned with said rotation magnet in a straight line.

DETAILED DESCRIPTION OF THE INVENTION

Figure 1:
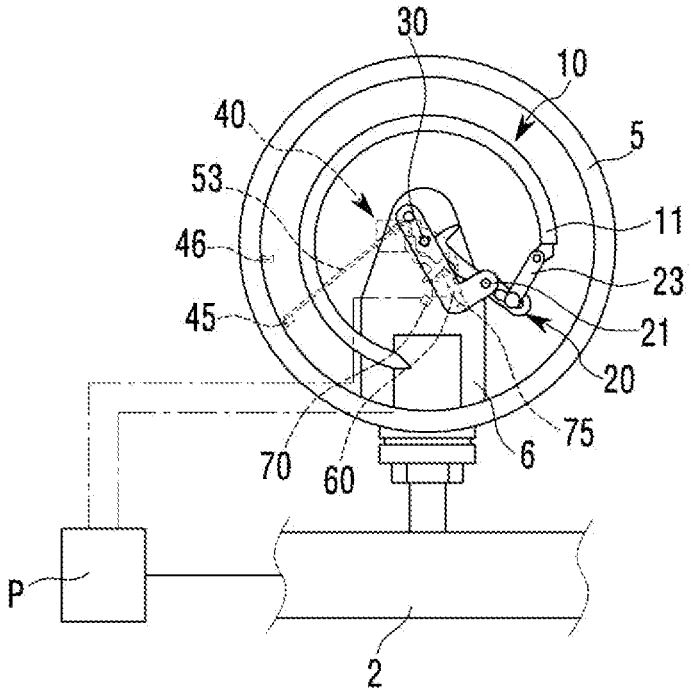
FIG. 1 is a schematic diagram of one embodiment of a pressure-type contact switch according to the present invention.

Hereinafter, a preferred embodiment of the present invention will be detailed with reference to the drawings.

Referring to FIGS. 1-5, a pressure-type contact switch of the present invention comprises: a bourdon tube (10) which expands or contracts depending on water-pressure in a discharge conduit (2) caused by a pressure pump (P); a first actuating lever (20) rotatably installed about a first rotation axis (21); and a link (23) having an one end connected to a free end (11) of the bourdon tube (10) and the other end connected to an end of the first actuating lever (20). A first semi-circle gear (20*a*) formed at an end of the first actuating lever (20) is engaged with a first link gear (32) fixed to a central rotation axis (30), so that the central rotation axis (30) rotates in a normal direction and a reverse direction according to the rotation of the first semi-circle gear (20*a*).

Figure 2:
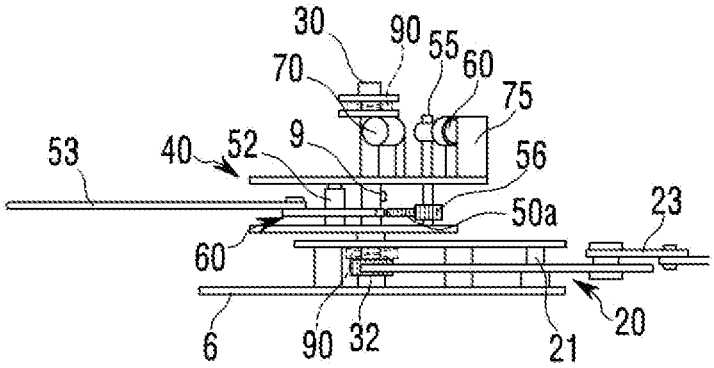
FIG. 2 is side view of the pressure-type contact switch shown in FIG. 1.
Figure 4:
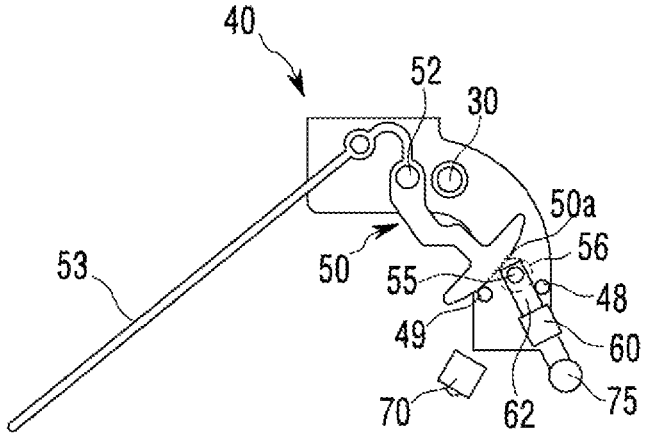
FIG. 4 is another partial view of the pressure-type contact switch of FIG. 1 to explain an operation, for example, an actuating member, an extension lever and a rotation axis.
Figure 6:
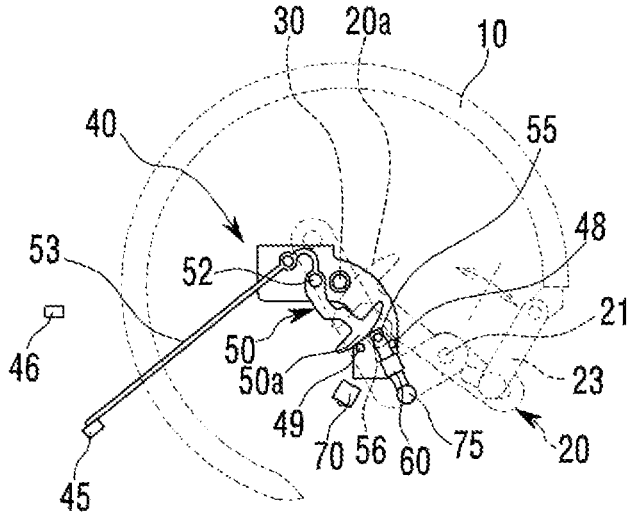
FIG. 6 is another partial view of the pressure-type contact switch of FIG. 1 to explain the operation of, for example, a bourdon tube, the actuating lever, and a link.
Figure 7:
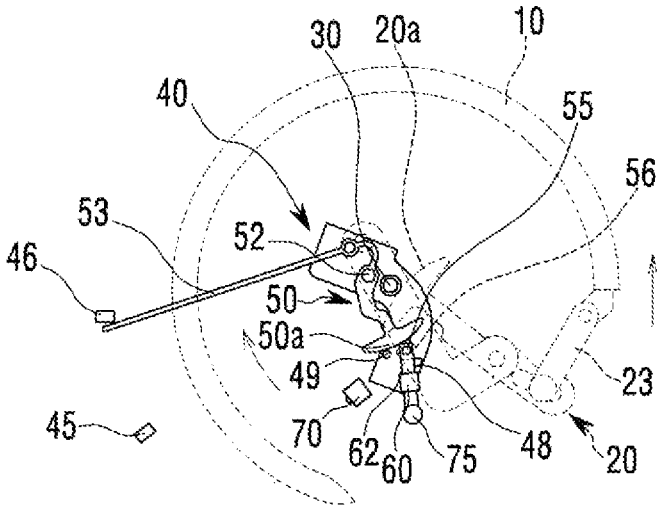
FIG. 7 is another partial view of the pressure-type contact switch of FIG. 1 to explain the operation of, for example, an extension lever, a movable support rod, and a stationary support rod.

A rotation member (40) fitted to the central rotation axis (30) has a second actuating lever (50). The second actuating lever (50) is rotatably installed about a second rotation axis (52). An extension lever (53) is connected to an end of the second actuating lever (50). The extension lever (53) rotates in a normal direction and in a reverse direction to thereby contact a movable support rod (45) and a stationary support rod (46), respectively, as shown in FIGS. 6-7. A second semi-circle gear (50*a*) is formed at the other end of the second actuating lever (50). A second semi-circle gear (50*a*) is engaged with a second link gear (56). As shown in FIG. 2, the second link gear (56) is fixed to a lower end of a third rotation axis (55). Also, as shown in FIGS. 2 and 4, a holder (62) is fixed to an upper end of the third rotation axis (55). The holder (62) has a rotation magnet (60) inserted into the holder (62). As the second link gear (56) is engaged with the second semi-circle gear (50*a*) of the second actuating lever (50), the third rotation axis (55) fitted to the second link gear (56) rotates in normal and reverse directions depending on the rotation of the second actuating lever (50).

The holder (62) with the rotation magnet (60) inserted therein rotates by means of the third rotation axis (55) in normal and reverse directions and this rotation is limited by a left stopper (49) and a right stopper (48). When the rotation magnet (60) stops its rotation by means of the left stopper (49), the rotation magnet (60) is aligned with a movable magnet (70) in a straight line. Then, repulsive force is generated between the rotation magnet (60) and the movable magnet (70) because they face each other with the same magnet poles. Thus, contacts points of the switch in the pressure pump turn into an off-state. When the rotation magnet (60) stops its rotation by means of the right stopper (48), the rotation magnet (60) is aligned with a stationary magnet (75) in a straight line. Then, attractive force is generated between the rotation magnet (60) and the stationary magnet (75) because they face each with the different magnet poles. Thus, the contacts points of the switch in the pressure pump turn into an on-state.

Figure 5:
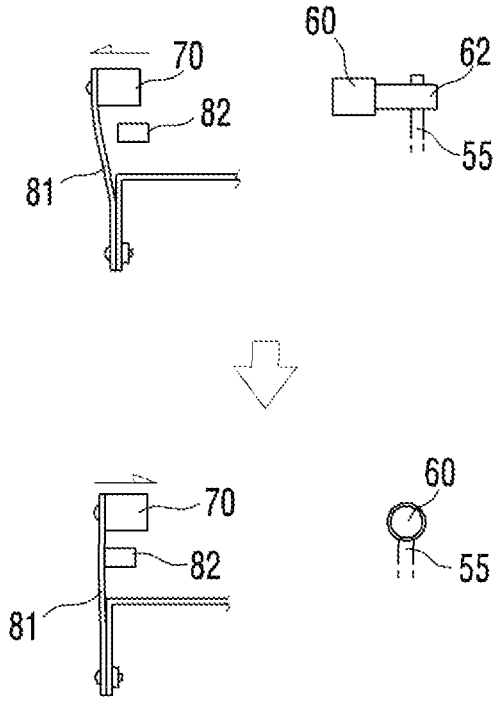
FIG. 5 is another partial view of the pressure-type contact switch of FIG. 1 to explain the operation of, for example, an movable magnet and a movable contact plate.

FIG. 5 shows that the movable magnet (70) is fixed to a movable contact plate (81) which may move forward and rearward in an elastic fashion. Also, a stationary contact (82) is arranged in front of the movable contact plate (81). The contact plate (81) and the stationary contact (82) may correspond to the contact points of the switch in the pressure pump as described above. Thus, when the movable magnet (70) is aligned with the rotation magnet (60) in a straight line as shown in an upper part of FIG. 5, the movable magnet (70) moves away from the rotation magnet (60) due to the repulsive force, to thereby cause a separation of the contact plate (81) from the stationary contact (82). As a result, it leads to an off-state of the switch as shown in a lower part of FIG. 5. When the movable magnet (70) is not aligned with the rotation magnet (60), the movable contact plate (81) can contact the stationary contact (82) due to the elasticity of the movable contact plate (81).

Also, as shown in FIG. 2, at least a spiral spring (90) is provided at the central rotation axis (30) so as to assist a return rotation of the central rotation axis (30) after the rotation in a normal direction.

In other words, an end of the spiral spring (90) is connected to the central rotation axis (30) and the other end of the spiral spring (90) is connected to a stationary base frame (6).

Also, a housing (5), the base frame (6) and a bolt (9) for coupling the rotation member (40) to the central rotation axis (30) are provided as shown in the drawings.

Herein-below, the present invention will be described with respect to its operation.

First, when power supply starts, the pressure pump (10) begins its operation.

At this stage, the rotation magnet (60) is aligned with the stationary magnet (75) in a straight line and the movable contact plate (81) is in contact with the stationary contact (82), so that the pressure pump (P) remains in its operational state.

In this state, the water pressure in the discharge conduit (2) which is applied by the pressure pump (P) is introduced into the bourdon tube (10) to thereby cause the bourdon tube (10) to expand due to the water pressure.

The expansion of the bourdon tube (10) makes the first actuating lever (20) to rotate in a normal direction by way of the link (23) connected to the end of the bourdon tube (10) as shown in FIG. 6.

When the first actuating lever (20) rotates in a normal direction, the first link gear (32), which is engaged with the semi-circle gear (20*a*) of the first actuating lever (20), is rotated, either. Accordingly, the central rotation axis (30) fitted to the link gear (32) can be rotated in a normal direction.

If the central rotation axis (30) rotates in a normal direction, the rotation member (40) fitted to the central rotation axis (30) is rotated in a normal direction, so that the extension lever (53) travels from a state wherein it contacts the movable support rod (45) as shown in FIG. 6 to the other state wherein it contacts the stationary support rod (46) as shown in FIG. 7.

When the extension member (53) of the rotation member (40) contacts the stationary support rod (46), the extension member (53) stops its rotation, but the rotation member (40) rotates a little further.

Also, the rotation of the first actuating member (50) connected to the extension lever (53) makes the third rotation axis (55) to be rotated due to the engagement between the semi-circle gear (50*a*) and the second link gear (56) as shown in FIG. 4.

Figure 8:
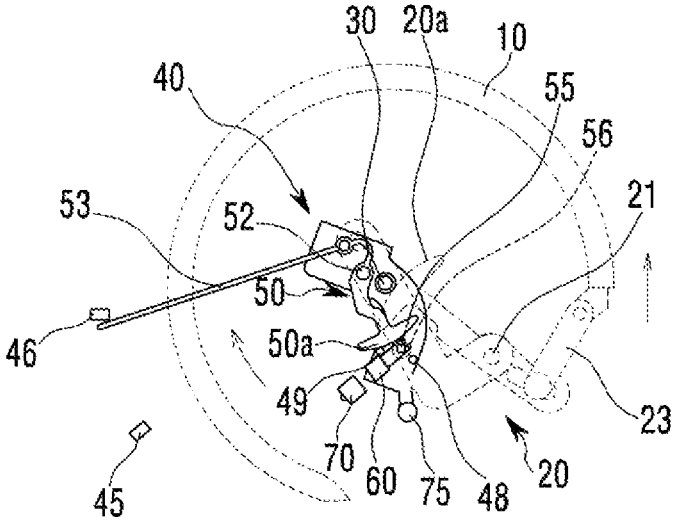
FIG. 8 is another partial view of the pressure-type contact switch of FIG. 1 to explain the operation of, for example, a rotation magnet, a station magnet, and a stopper.

Further, the rotation magnet (60), which is inserted in the holder (62) fitted to the upper end of the third rotation axis (55), rotates due to the rotation of the third rotation axis (55), wherein the rotation magnet (60) is pushed as soon as it comes out of alignment with the stationary magnet (75), and the rotation magnet (60) rotates until it contacts the stopper (49) as shown in FIG. 8.

Then, the rotation magnet (60) reaches the alignment with the movable magnet (70) in a straight line, and thus the movable magnet (70) makes the movable contact plate (81) to be elastically separated from the stationary contact (82) due to the repulsive force between the same poles of the magnets.

When the movable contact plate (81) is separated from the stationary contact (82), the pressure pump (P) stops in its operation and the water pressure decreases to thereby cause the bourdon tube (10) to contract in its volume.

Figure 3:
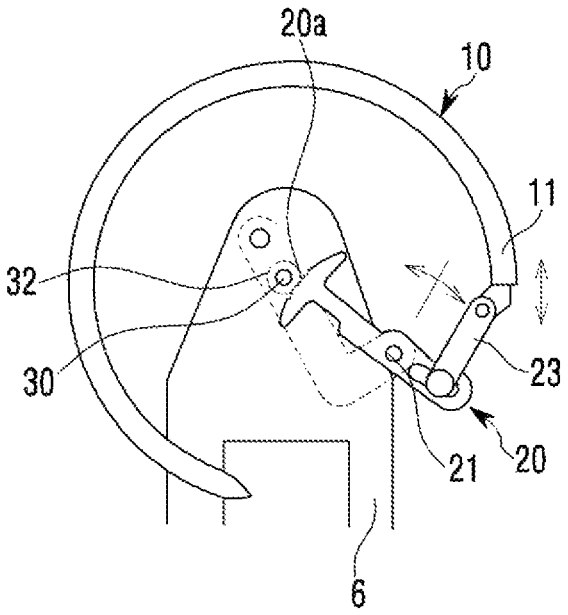
FIG. 3 is a partial view of the pressure-type contact switch of FIG. 1 to explain an operation, for example, a central rotation axis, a semi-circle gear, an actuating lever and a link gear.

If the volume of the bourdon tube (10) decreases, the first actuating lever (20) coupled thereto by way of the link (23) rotates in a reverse direction, and thus the central rotation axis (30) rotates in a reverse direction, because the semi-circle gear (20*a*) at the end of the first actuating lever (20) is engaged with the first link gear (32) fitted to the central rotation axis (30) as shown in FIG. 3.

Then, the rotation member (40) fixed to the central rotation axis (30) rotates in a reverse direction, and thus the extension lever (53) rotates in a reverse direction to travel toward its original position.

Here, the third rotation axis (55) is rotated in a reverse direction, because the second link gear (56) fitted to the third rotation axis (55) is engaged with the semi-circle gear (50*a*) formed at the end of the second actuating lever (50). Accordingly, the rotation magnet (60) fitted to the third rotation axis (55) is rotated toward its original position, so that it turns into the alignment with the stationary magnet (75) in a straight line.

If the rotation magnet (60) is aligned with the stationary magnet (75) in a straight line again, the movable contact plate (81) elastically moves to contact the stationary contact (82). Thus, the pressure pump (P) may begins its operation once again.

As described above, the pressure-type contact switch of the present invention can perform its on/off operation by way of the expansion and the contraction of the bourdon tube according to the operation and the cessation of the pressure pump. Particularly, with the use of the rotation magnet, the stationary magnet and the movable magnet, the switch of the present invention can uniformly maintain its on/off state, despite the instantaneous change in pressure, until the extension lever contacts the movable support rod or the stationary support rod.

The invention claimed is:

1. Pressure-type contact switch comprising:

a bourdon tube (10) which expands and contracts depending on water pressure in a discharge conduit (2) applied by a pressure pump (P);

a link (23) having an end connected to a free end (11) of said bourdon tube (10);

a first actuating lever (20) having an end connected to the other end of said link (23) and rotatably installed about a first rotation axis (21);

a first semi-circle gear (20*a*) formed at the other end of said first actuating lever (20);

a first link gear (32) engaged with said first semi-circle gear (20*a*) and fitted to a central rotation axis (30) to thereby cause said central rotation axis (30) to rotate in normal and reverse directions;

a rotation member (40) fitted to said central rotation axis (30);

a second actuating lever (50) which is installed to said rotation member (40) to be rotatable about a second rotation axis (52);

an extension lever (53) fitted to an end of said second actuating lever (50), wherein a rotation of said extension lever (53) in normal and reverse directions is limited by a movable support rod (45) and a stationary support rod (46);

a second semi-circle gear (50*a*) formed at the other end of said second actuating lever (50);

a holder (62) fitted to an upper end of a third rotation axis (55) and having a rotation magnet (60) inserted therein;

a second link gear (56) fitted to a lower end of said third rotation axis (55) and engaged with said second semi-circle gear (50*a*) to thereby rotate said third rotation axis (55) in normal and reversed directions depending on the rotation of said second semi-circle gear (50*a*);

a movable magnet (70) arranged to be aligned with said rotation magnet (60) in a straight line when said rotation magnet (60) stops in its rotation by a first stopper (49), wherein the pressure pump (P) turns off due to repulsive force between said rotation magnet (60) and said movable magnet (70); and, a stationary magnet (75) arranged to be aligned with said rotation magnet (60) in a straight line when said rotation magnet (60) stops in its rotation by a second stopper (48), wherein the pressure pump (P) turns on when the stationary magnet (75) is aligned with the rotation magnet (60).

2. Pressure-type contact switch as claimed in claim 1, wherein said movable magnet (70) is fixed to a contact plate (81) which is elastically bendable, and wherein said contact plate (81) is separated from a stationary contact (82) to thereby turn off the pressure pump (P) when said movable magnet (70) is aligned with said rotation magnet (60) in a straight line.

* * * * *